United States Patent [19]

van der Wal

[11] 4,211,349

[45] Jul. 8, 1980

[54] METHOD AND A DEVICE FOR APPLYING AN ENLACING TAPE AROUND AN OBJECT

[75] Inventor: Auke van der Wal, Oss, Netherlands

[73] Assignee: Vereenigde Metaalverpakking en Hecktdraad Industrie B.V. MVM-ENDRA

[21] Appl. No.: 967,638

[22] Filed: Dec. 8, 1978

[30] Foreign Application Priority Data

Dec. 8, 1977 [NL] Netherlands ..... 7713625

[51] Int. Cl.[2] ..... B65H 17/18

[52] U.S. Cl. ..... 226/171; 100/26; 226/94

[58] Field of Search ..... 226/94, 1, 93, 168, 226/170, 171; 100/26, 33 PB; 156/157

[56] References Cited

U.S. PATENT DOCUMENTS

| | | | |
|---|---|---|---|
| 3,331,312 | 7/1967 | Leslie et al. | 100/33 PB UX |
| 3,353,734 | 11/1967 | Burdorf et al. | 226/94 |
| 3,548,740 | 12/1970 | Kobiella | 100/33 PB X |
| 3,768,396 | 10/1973 | Coleman | 100/26 |
| 4,009,877 | 3/1977 | Ward, Jr. | 226/171 X |
| 4,118,179 | 10/1978 | Ballinger | 226/171 X |

FOREIGN PATENT DOCUMENTS

| | | | |
|---|---|---|---|
| 588480 | 11/1933 | Fed. Rep. of Germany . | |
| 2739542 | 3/1978 | Fed. Rep. of Germany | 226/171 |
| 716229 | 9/1954 | United Kingdom | 226/94 |

*Primary Examiner*—Stanley N. Gilreath
*Attorney, Agent, or Firm*—John P. Snyder

[57] ABSTRACT

A method of and a device for applying an enlacing tape around an object, in which the tape is taken along its path around the object to be enlaced by an endless conveyor oelt by its being held urged against said belt and at the same time is fed by a tape feeding device at the speed of the belt during the full period of its movement around the object.

21 Claims, 3 Drawing Figures

FIG.1
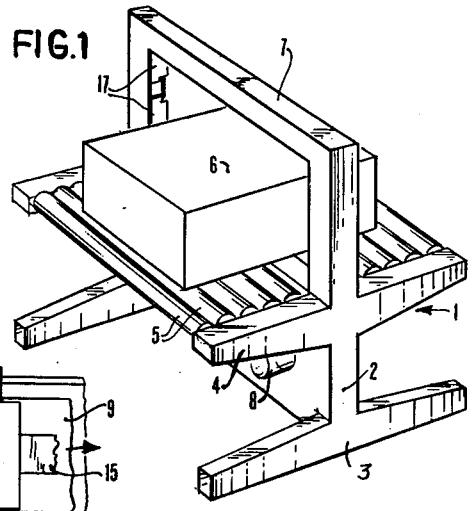
FIG.3
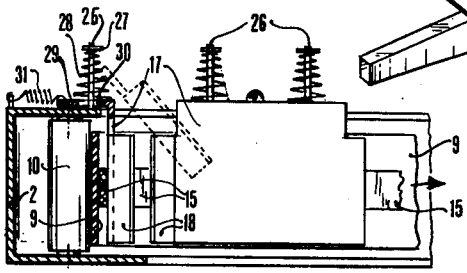
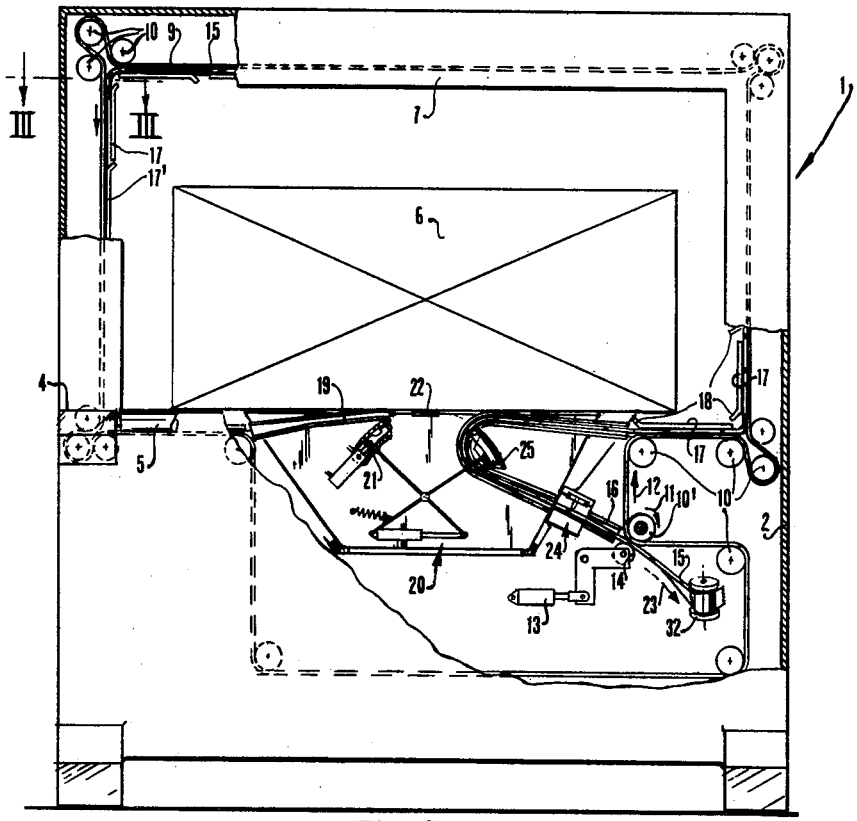
FIG.2

METHOD AND A DEVICE FOR APPLYING AN ENLACING TAPE AROUND AN OBJECT

The invention relates to a method of applying an enlacing tape, particularly flexible tape, for example of a synthetic resin, a tissue or paper around an object, said tape being brought by a driven tape supplying device into contact with at least one endless conveyor belt moving in a space around the object to be enlaced, the tape being carried along by the conveyor belt in its path and to a device for carrying out said method comprising an endless conveyor belt movable along a path in a space around an object to be enlaced, a device for driving the conveyor belt, an intermittently drivable tape feeding device, by which the enlacing tape is brought into contact with the conveyor belt and means for coupling the two tapes so that the conveyor belt carries along the enlacing tape in its path.

Hitherto it has been common practice to feed a flexible enlacing tape in a manner such that its end was gripped by a clamping device fastened for this purpose to the conveyor belt so that the enlacing tape was drawn along by the conveyor belt. During this advance the tape feeding device has to be uncoupled. In enlacing with a rigid tape, for example, a metal tape, the tape was usually pushed on by means of a feeding device through a gutter or guide extending around the space for the object to be enlaced.

In both cases the user needed a device especially designed for a given type of tape, whilst in enlacing with flexible tape starting and stopping of the various functions had to be relatively adjusted with high accuracy.

According to the invention the above-mentioned disadvantages can be obviated by driving the enlacing tape by the tape feeding device with the speed of the conveyor belt for the full period of its movement around the object and by holding the tape throughout its length along the path of the conveyor belt in intimate contact with the conveyor belt. In addition, the invention provides a device for carrying out said method, in which the conveyor-belt driving device and the tape feeding device are designed so that they drive the tape concerned with the same speed, there being provided means for urging the enlacing tape throughout its length covering the path of the conveyor belt against the conveyor belt.

It is advantageous to have the conveyor belt or the driving device thereof constitute at the same time the driving device for feeding the enlacing tape. The conveyor belt and the enlacing tape can thus extend in joined relationship between two transport or guide rollers resiliently urged towards one another. The friction contact between the belt and the tape can be enhanced and ensured by spring-loaded pressing plates, which can be turned out of the path during the enlacing operation so that the tape can join the object to be enlaced. Moreover, an electrostatic charge applied to at least one of the tapes may be employed so that the belt and the tape attract one another and establish a satisfactory contact between them.

The invention will be described more fully with reference to the drawing in which:

FIG. 1 is a perspective view of an enlacing device in accordance with the invention, FIG. 2 is a front view and partly a sectional view of the enlacing device of FIG. 1 and FIG. 3 is partly an elevational view and partly a sectional view taken on the line III—III of FIG. 2.

FIG. 1 illustrates an embodiment of an enlacing device 1 in accordance with the invention. It comprises a framework 2 including a foot 3 and arms 4 for carrying rollers 5 for conveying the object 6 to be enlaced towards a space bounded by a portal 7. A motor 8 drives a conveyor belt 9 (not shown in FIG. 1) located inside the profile of the portal 7 opened towards the inner side. The transport rollers 5 may be provided with driving means for transporting the objects to be enlaced.

FIG. 2 shows the enlacing device 1 of FIG. 1 partly in a front view and partly in a sectional view taken in a plane going through the portal 7. In all Figures corresponding elements are designated by the same reference numerals.

The endless conveyor belt 9 is guided by means of guide rollers 10, one of which, for example, the roller designated by 10′ is rotatably driven in the direction indicated by the arrow 11 so that the conveyor belt moves along its path defined by the rollers 10, 10′ in the direction of the arrow 12. By a member 13 a freely rotatable roller 14 can be urged against the driving roller 10′ so that one end of an enlacing tape 15 originating from a supply reel 32, which end is located between the conveyor belt 9 and the pressing roller 14, is pushed on along a narrow U-shaped gutter or guide 16, opening towards the front side of the device 1 with the same speed as the conveyor belt.

The enlacing tape 15 leaves the gutter 16 in a direction such that it moves parallel to the conveyor belt 9. On the side of the conveyor belt 9 directed towards the free space intended for the object 6 to be enlaced, smooth pressing plates or guide plates 17 subjected to spring force can be tilted out of the path, said plates exerting a slight pressure on the enlacing tape 15 applied to the conveyor belt 9. On the side lying at the front, viewed in the direction of movement of the belt and tape, the pressing plates are provided with location finding rims 18 (FIG. 3). In the drawing the pressing plates urged away by the enlacing tape 15 are designated by reference numeral 17. The numeral 17′ designates a pressing plate in its rest position not yet reached by the enlacing tape.

The contact between the enlacing tape and the conveyor belt is established solely by friction.

The three guide rollers 10 at the four corners of the space intended for the object to be enlaced are disposed so that the enlacing tape is guided fairly sharply around the corner. After the wrapping tape has passed through four angles of 90° it leaves the conveyor belt, which is guided outwards. The enlacing tape travelling on along a substantially straight line is guided into a slightly tapering, substantially horizontal gutter or guide 19, opening towards the front and guiding the wrapping tape downwards near the centre of the wrapping device 1. When the wrapping tape has arrived at this position, its end is clamped tight between the pressing element 21 and the stop plate 22, and the unit 20 including the gutters 16 and 19 is withdrawn over such a distance that the guide is released from the enlacing tape. At the same time the roller 14 is released by the member 13 from the conveyor belt 9 and the enlacing tape 15 so that at the area of the roller 14 the enlacing tape is released from the conveyor belt and is withdrawn by the reaction of the supply reel 32, which is provided with withdrawing means (not shown) for this purpose.

Owing to the tractive force in the tape an inwardly directed force is produced as a result of which the pressing plates 17 tilt aside and the tape is applied around the object to be enlaced. After the tape is tightened around the object, the clamping device 24 is energized to tighten the enlacing tape. The subsequently rising pressing element 25 advances the enlacing tape in front of it and produces the desired tensile force in the tape.

After the enlacing tape is clamped tight between the stop plate 22 and the pressing element 25 it is cut off, the two free ends being subsequently interconnected in known manner, for example, by welding or gluing.

After the enlacing tape is thus tightly applied around the object, the operation terminates. The object is removed from the wrapping device, for example, by rotatably driving one or more of the rollers 5. The device 1 is then ready for wrapping a next object.

From FIG. 3 it is apparent that the pressing plates 17 are loaded by slack compression springs 28 and at least one tensile spring 31. Their movement is furthermore limited in that they grip around a pin 26 having a stop surface 27 and surrounded by the compression spring 28 by means of an elongated hole 30. The hole 30 is made so large that when the enlacing tape leaves the conveyor belt by tensile force, the plate 17 tilts away into the position indicated by dotted lines in FIG. 3 so that the enlacing tape can freely advance towards the object to be enlaced. After the passage of the enlacing tape the plate 17 resiliently returns to its rest position.

It should be noted that the pressing plates may be resiliently tilted away in a different manner, for example, by means of a hinge and a torsional spring around the hinge shaft.

The use of pressing plates may, as an alternative, be dispensed with by applying such an electrostatic charge to the enlacing tape and/or the conveyor belt that the tape and the belt exert an attractive force one on the other.

It will be obvious that the conveyor belt may be driven continuously as well as intermittently.

It is furthermore possible to use units comprising more than one enlacing device, for example, for enlacing large objects with more than one enlacing tape.

The rollers 5 may be replaced by two conveyor belts, one on each side of the device 1.

What I claim is:

1. A device for applying an enlacing tape around an object comprising means for supporting an object adapted to be enlaced by a tape, endless conveyor belt means generally surrounding said supporting means for moving the tape along a path around the object from an entrance end toward an exit end of said path, means for continuously moving said endless conveyor belt means during the introduction of an end of the tape at the entrance end of said path until the departure of said tape end at said exit end, means for continuously driving the tape at the speed of movement of said endless conveyor belt means during the movement of the tape between said entrance and exit ends whereby the continuous driving movement of said continuous driving means and the continuous movement of said endless conveyor belt means at commensurate speeds results in the enlacing of the tape around the object, and means for urging the tape against the endless conveyor belt means along the length of said path between said entrance and exit ends.

2. The tape enlacing device as defined in claim 1 wherein said tape driving means includes means for holding the tape in contact with a portion of the endless conveyor belt means whereby the drive for the tape is the moving means for the endless conveyor belt means.

3. The tape enlacing device as defined in claim 1 including means for deactivating the endless conveyor belt moving means and the tape driving means after the tape has been enlaced about an object and the tape end introduced at the entrance end of the path has departed the exit end thereof.

4. The tape enlacing device as defined in claim 1 wherein said endless conveyor belt means includes at least one endless conveyor belt having a single run totally defining said path and surrounding said supporting means.

5. The tape enlacing device as defined in claim 1 including means for effecting the release of the tape from between the endless conveyor belt means and the urging means by the inward movement of said tape along a path other than normal to the path of the endless conveyor belt means.

6. The tape enlacing device as defined in claim 1 wherein said endless conveyor belt moving means includes a driven rotating roller in driving engagement with a run of said endless conveyor belt means, and said tape driving means includes a roller holding the tape in contact with said run whereby the movement of the run drives the tape during the latter's movement along said path.

7. The tape enlacing device as defined in claim 1 including means for mounting said urging means for tilting movement relative to said endless conveyor belt means for effecting the release of the tape.

8. The tape enlacing device as defined in claim 1 wherein said endless conveyor belt means includes at least one endless conveyor belt having a single run totally defining said path and surrounding said supporting means, first guide means within said path at said entrance end for directing a tape end into sandwiched relationship between said endless conveyor belt means and said tape urging means, and second guide means within said path at said exit end for directing a tape end away from its sandwiched relationship between said endless conveyor belt means and said tape urging means.

9. The tape enlacing device as defined in claim 2 including means for deactivating the endless conveyor belt moving means and the tape driving means after the tape has been enlaced about an object and the tape end introduced at the entrance end of the path has departed the exit end thereof.

10. The tape enlacing device as defined in claim 2 wherein said endless conveyor belt means includes at least one endless conveyor belt having a single run totally defining said path and surrounding said supporting means.

11. The tape enlacing device as defined in claim 2 including means for effecting the release of the tape from between the endless conveyor belt means and the urging means by the inward movement of said tape along a path other than normal to the path of the endless conveyor belt means.

12. The tape enlacing device as defined in claim 2 including means for mounting said urging means for tilting movement relative to said endless conveyor belt means for effecting the release of the tape.

13. The tape enlacing device as defined in claim 2 wherein said endless conveyor belt means includes at least one endless conveyor belt having a single run totally defining said path and surrounding said supporting means, first guide means within said path at said entrance end for directing a tape end into sandwiched relationship between said endless conveyor belt means and said tape urging means, and second guide means within said path at said exit end for directing a tape end away from its sandwiched relationship between said endless conveyor belt means and said tape urging means.

14. The tape enlacing device as defined in claim 5 wherein said endless conveyor belt moving means includes a driven rotating roller in driving engagement with a run of said endless conveyor belt means, and said tape driving means includes a roller holding the tape in contact with said run whereby the movement of the run drives the tape during the latter's movement along said path.

15. The tape enlacing device as defined in claim 5 including means for mounting said urging means for tilting movement relative to said endless conveyor belt means for effecting the release of the tape.

16. The tape enlacing device as defined in claim 5 wherein said endless conveyor belt means includes at least one endless conveyor belt having a single run totally defining said path and surrounding said supporting means, first guide means within said path at said entrance end for directing a tape end into sandwiched relationship between said endless conveyor belt means and said tape urging means, and second guide means within said path at said exit end for directing a tape end away from its sandwiched relationship between said endless conveyor belt means and said tape urging means.

17. The tape enlacing device as defined in claim 6 including means for mounting said urging means for tilting movement relative to said endless conveyor belt means for effecting the release of the tape.

18. The tape enlacing device as defined in claim 6 wherein said endless conveyor belt means includes at least one endless conveyor belt having a single run totally defining said path and surrounding said supporting means.

19. The tape enlacing device as defined in claim 6 wherein said endless conveyor belt means includes at least one endless conveyor belt having a single run totally defining said path and surrounding said supporting means, first guide means within said path at said entrance end for directing a tape end into sandwiched relationship between said endless conveyor belt means and said tape urging means, and second guide means within said path at said exit end for directing a tape end away from its sandwiched relationship between said endless conveyor belt means and said tape urging means.

20. The tape enlacing device as defined in claim 17 including means for effecting the release of the tape from between the endless conveyor belt means and the urging means by the inward movement of said tape along a path other than normal to the path of the endless conveyor belt means.

21. The tape enlacing device as defined in claim 17 wherein said endless conveyor belt means includes at least one endless conveyor belt having a single run totally defining said path and surrounding said supporting means, first guide means within said path at said entrance end for directing a tape end into sandwiched relationship between said endless conveyor belt means and said tape urging means, and second guide means within said path at said exit end for directing a tape end away from its sandwiched relationship between said endless conveyor belt means and said tape urging means.

* * * * *